US011007416B2

(12) United States Patent
Miller

(10) Patent No.: US 11,007,416 B2
(45) Date of Patent: May 18, 2021

(54) PICKLEBALL BARRIER

(71) Applicant: David Miller, Plymouth, IN (US)

(72) Inventor: David Miller, Plymouth, IN (US)

( * ) Notice: Subject to any disclaimer, the term of this patent is extended or adjusted under 35 U.S.C. 154(b) by 0 days.

(21) Appl. No.: 16/406,636

(22) Filed: May 8, 2019

(65) Prior Publication Data

US 2019/0344148 A1 Nov. 14, 2019

Related U.S. Application Data

(60) Provisional application No. 62/668,730, filed on May 8, 2018.

(51) Int. Cl.
*A63B 71/02* (2006.01)
*E04H 17/16* (2006.01)
*A63B 69/00* (2006.01)

(52) U.S. Cl.
CPC ..... *A63B 71/022* (2013.01); *E04H 17/16* (2013.01); *A63B 69/0097* (2013.01)

(58) Field of Classification Search
CPC ..... E04H 17/16; E04H 17/00; E04B 2/02; A63B 67/04; A63B 69/0097; A63B 2102/16; A63B 2210/50; A63B 71/022
See application file for complete search history.

(56) References Cited

U.S. PATENT DOCUMENTS

| | | | | |
|---|---|---|---|---|
| 4,014,521 | A * | 3/1977 | Berman | A63C 19/06 256/1 |
| D778,751 | S * | 2/2017 | Cooper | A47D 13/065 D10/113.3 |
| 9,624,630 | B1 * | 4/2017 | Maus | E04H 17/16 |
| 2006/0054877 | A1 * | 3/2006 | Wright | E04H 17/16 256/21 |
| 2007/0090335 | A1 * | 4/2007 | Legrand | A47D 13/065 256/24 |
| 2017/0030083 | A1 * | 2/2017 | Matturro | E04H 17/18 |
| 2017/0370119 | A1 * | 12/2017 | Powlen | E04H 17/16 |
| 2019/0344148 | A1 * | 11/2019 | Miller | E04H 17/16 |

* cited by examiner

*Primary Examiner* — Raleigh W Chiu
(74) *Attorney, Agent, or Firm* — Brannon Sowers & Cracraft PC

(57) ABSTRACT

A deployable pickleball barrier includes a plurality of panels having a first rigid surface, a second rigid surface, and a substantially straight channel coupling the rigid surfaces. Each of the plurality of panels are coupled with another of the plurality of panels by an interpanel joint that includes a rigid bond and a plurality of fold lines formed in the first rigid surface to form a rightwardly biasing hinge. Each of the plurality of panels includes an intrapanel joint including a plurality of fold lines formed in the second rigid surface to form a leftwardly biasing hinge. The deployable pickleball barrier can be folded at each of the hinges to alternate between a deployed configuration and a folded configuration.

19 Claims, 4 Drawing Sheets

PICKLEBALL BARRIER

CROSS-REFERENCE TO RELATED APPLICATIONS

The present application claims priority under 35 U.S.C. § 119(e) to U.S. Patent Provisional Application Ser. No. 62/668,730 filed May 8, 2018.

TECHNICAL FIELD

The present disclosure relates generally to deployable sports barriers and, more particularly, to deployable folding barriers for use with pickleball courts.

BACKGROUND

The sport of pickleball has been growing rapidly in recent years as it is a fun, engaging, and low impact activity for all ages and skill levels. Pickleball is similar to tennis in a number of ways. Both are played on a rectangular court and involve volleying a ball over a net by way of a racquet. While tennis is often a highly-competitive, fast-paced—oftentimes expensive—sport, pickleball is typically more of a friendly, slow-paced game played with relatively inexpensive equipment, notably, a flat, solid racquet and a whiffle-type ball. Some have attributed pickleball's growing popularity, at least in part, to the comparatively lower physical and financial barriers to entry.

Pickleball has proven to be popular within the senior citizen community, for instance. Many have recognized the game provides an enjoyable, accessible activity that can help seniors to achieve recommended levels of physical activity helpful in combatting the onset or worsening of many medical conditions such as Alzheimer's, heart disease, constipation, high blood pressure, obesity, and a wide array of other conditions that commonly affect the cardiovascular, cognitive, respiratory, skeletomuscular, or gastrointestinal health of those of advancing age. These benefits are not limited to the elderly, however. In fact, initiatives promoting fun, easy methods of increasing individuals' level of physical activity have become increasingly common, and may be important tools in the fight against increasing rates of obesity, diabetes, and other health ailments that may result from a sedentary lifestyle.

The relatively low costs associated with pickleball have also led to many embrace the game. For instance, pickleball generally requires the purchase of only a pickleball paddle and a quantity of pickleballs, both of which can often be obtained for about $100.00. In contrast, tennis and racquetball racquets are typically at least two to three times more expensive, and require regular maintenance. The lower costs associated with pickleball has also led to rapid adoption of the sport by organizations and institutions such as retirement communities, schools, and public parks, which has in turn seen a corresponding rise in the number of venues dedicated to or adapted for use in pickleball matches.

This growth has not come without consequences, however. In what has become a common scene in recent years, several pickleball courts are often packed into a single venue to allow multiple games to be played concurrently. As with tennis, volleyball, and other volley sports, errant balls frequently escape courts during play. Increasingly crowded venues featuring multiple games being played in close proximity means that errant pickleballs are more likely to interrupt ongoing matches in neighboring pickleball courts. The game's growth has thus caused what was once a relatively infrequent annoyance to mature into a routine inconvenience for players that may hinder or limit further growth. Further, and perhaps more importantly, stray pickleballs may be dangerous as stepping on wayward pickleballs may cause players, observers, or others to slip, trip, or otherwise fall, amongst other things.

Attempts to address this issue have largely involved using barriers structured for use in other games, such as table tennis. Such strategies may not be easily adapted for use with pickleball, however, as pickleball is unique in that it can be played both indoors and outdoors. Further, pickleball players often have different motivations and circumstances than tennis players or table tennis players. For example, barriers produced by brands such as JOOLA® and Stiga® are sometimes used for pickleball, but these barriers are generally intended for indoor use, and are small, heavy, and relatively expensive. Even larger, lighter, and less expensive table tennis barriers may still not be particularly well suited for use in the context of pickleball, especially outdoor pickleball matches. For example, United States Patent Application Publication No. 2017/0370119 to Powlen ("Powlen") discloses a foldable cardboard table tennis barrier apparently formed by joining pieces of cardboard together by movable joints. While these and other strategies may be suitable for certain uses in certain environments, improved and/or alternative strategies for cost effectively and reliably preventing errant balls from interrupting pickleball matches—whether indoor or outdoor—remain desirable.

SUMMARY OF THE INVENTION

In one aspect, a deployable pickleball barrier includes a plurality of panels formed of a plastic material having a first surface and a second surface in a spaced arrangement, each of the plurality of rigid panels having a height of about 2-feet or less, and a plurality of interpanel joints coupling each of the plurality of panels to another one of the plurality of panels such that the weather resistant deployable pickleball barrier has a substantially continuous extent. Each of the interpanel joints includes a rigid bond and a plurality of fold lines formed in the first surface, the plurality of fold lines being structured to cause the deployable pickleball barrier to bias in a righthand direction. The deployable pickleball barrier further includes a plurality of intrapanel joints each including a plurality of fold lines structured to cause the deployable pickleball barrier to bias in a lefthand direction, and a stand rotatably coupled with one of the plurality of panels such that the stand can be rotated between a support orientation substantially perpendicular to the corresponding one of the plurality of panels, and a transport orientation substantially parallel with the corresponding one of the plurality of panels.

In another aspect, a pickleball barrier includes a plurality of panels formed of a substantially straight fluted material having a plurality flutes disposed between a first surface and a second surface, the plurality of panels joined together in a chain-like manner and extending a majority of a length of a pickleball court between baselines. The pickleball barrier further includes an interpanel joint having a rigid bond and a plurality of fold lines formed in the first surface, and a plurality of intrapanel joints including a plurality of fold lines formed in the second surface, wherein a first one of the plurality of panels is coupled to a second one of the plurality of panels by the interpanel joint.

In another aspect, a pickleball barrier includes a plurality of panels having a top edge, a bottom edge, and two side edges, the plurality of panels being formed of a multiple layered material having a first rigid surface and a second rigid surface, wherein the first rigid surface and the second rigid surface are coupled so as to form a plurality of substantially straight channels extending between the top edge and the bottom edge. The pickleball barrier also includes a plurality of interpanel joints rigidly coupling the plurality of panels in a chain-like manner. The pickleball barrier further includes a rightwardly biasing hinge having a plurality of fold lines formed in the first rigid surface and corresponding with one of the plurality of substantially straight channels, each of the plurality of fold lines being structured to cause the pickleball barrier to bias in a right-hand direction, and a leftwardly biasing hinge having a plurality of fold lines formed in the second rigid surface and corresponding with one of the plurality of substantially straight channels, each one of the plurality of fold lines structured to cause the pickleball barrier to bias in a lefthand direction. The plurality of rightwardly biasing hinges and the plurality of leftwardly biasing hinges are formed at equal intervals within the pickleball barrier in an alternating arrangement.

In another aspect, a method of transporting a pickleball barrier formed of a plurality of multiple layered panels that each include a substantially straight channel disposed between a first rigid surface and a second rigid surface, the pickleball barrier having a configurable stand, a plurality of rightwardly biasing hinges formed in the first rigid surface, and plurality of leftwardly biasing hinges formed in the second rigid surface and interspersing the plurality of rightwardly biasing hinges, the plurality of rightwardly biasing hinges and the plurality of leftwardly biasing hinges dividing the barrier into a plurality of substantially equal length sections each having a first rigid surface and a second rigid surface, the method including folding the pickleball barrier in a righthand direction at the rightwardly biasing hinges to register a first section of the pickleball barrier with a second section of the pickleball barrier adjacent to the first section such that the first rigid surface of the first section contacts the first rigid surface of the second section, each rightwardly biasing hinge including a plurality of fold lines formed in the first rigid surface of the pickleball barrier. The method further includes folding the pickleball barrier in a lefthand direction at the leftwardly biasing hinges to register the second section with a third section of the pickleball barrier adjacent to the second section such that the second rigid surface of the second section contacts the second rigid surface of the third section, each leftwardly biasing hinge including a plurality of fold lines formed in the second rigid surface of the pickleball barrier. The method further includes changing a configuration of the configurable stand such that the configurable stand registers with the section with which the configurable stand is coupled.

In another aspect, a method of packaging a deployable pickleball barrier includes cutting the weather resistant material into panels each having a height of about 2-feet or less, the weather resistant material having a first rigid surface and a second rigid surface coupled to the first rigid surface by a substantially straight channel, and rigidly attaching the panels in a chain-like manner to form a substantially straight deployable pickleball barrier having a height of about 2-feet or less, each of the panels being attached to at least one other panel by an interpanel joint. The method further includes configuring the deployable pickleball barrier to have a deployed configuration in which the deployable pickleball barrier has an accordion-like shape at least in part by: forming a plurality of fold lines in the first rigid surface within each of the interpanel joints to form a rightwardly biasing hinge structured to bias the deployable pickleball barrier in a righthand direction, and forming a plurality of intrapanel joints within the deployable pickleball barrier such that each pair of intrapanel joints is interrupted by an interpanel joint, each of the plurality of intrapanel joints including a plurality of fold lines formed in the second rigid surface to form a leftwardly biasing hinge structured to bias the deployable pickleball barrier in a lefthand direction, wherein the alternating arrangement of the intrapanel joints and the interpanel joints forms a plurality of substantially equal length sections within the deployable pickleball barrier. The method further includes adjusting the deployable pickleball barrier to a folded configuration in which each of the plurality of sections registers with an adjacent one of the plurality of sections by: folding the deployable pickleball barrier in the righthand direction at each of the plurality of interpanel joints, and folding the deployable pickleball barrier in the lefthand direction at each of the plurality of intrapanel joints.

In still another aspect, a pickleball barrier includes a plurality of rigid panels including a first end panel, a second end panel, and a middle panel, the plurality of rigid panels being formed of a corrugated plastic material having a first rigid surface, a second rigid surface, and a plurality of flutes coupling the first rigid surface with the second rigid surface, each of the panels having a height of about 2-feet or less. A plurality of interpanel joints each attach one of the plurality of panels to another one of the plurality of panels such that the plurality of panels have a chain-like arrangement that is about 20-feet long or greater in a deployed configuration, each of the plurality of interpanel joints including a rigid bond and a plurality of fold lines in the first rigid surface forming a rightwardly biasing hinge. A plurality of intrapanel joints include a plurality of fold lines in the second rigid surface forming a leftwardly biasing hinge, each intrapanel joint dividing each of the plurality of rigid panels into two substantially equal sections, with each section including a handle opening. A stand is rotatably coupled with one of the plurality of panels such that the stand is partially within one of the plurality of flutes of the corresponding on of the plurality of panels.

DETAILED DESCRIPTION

Figure 1:
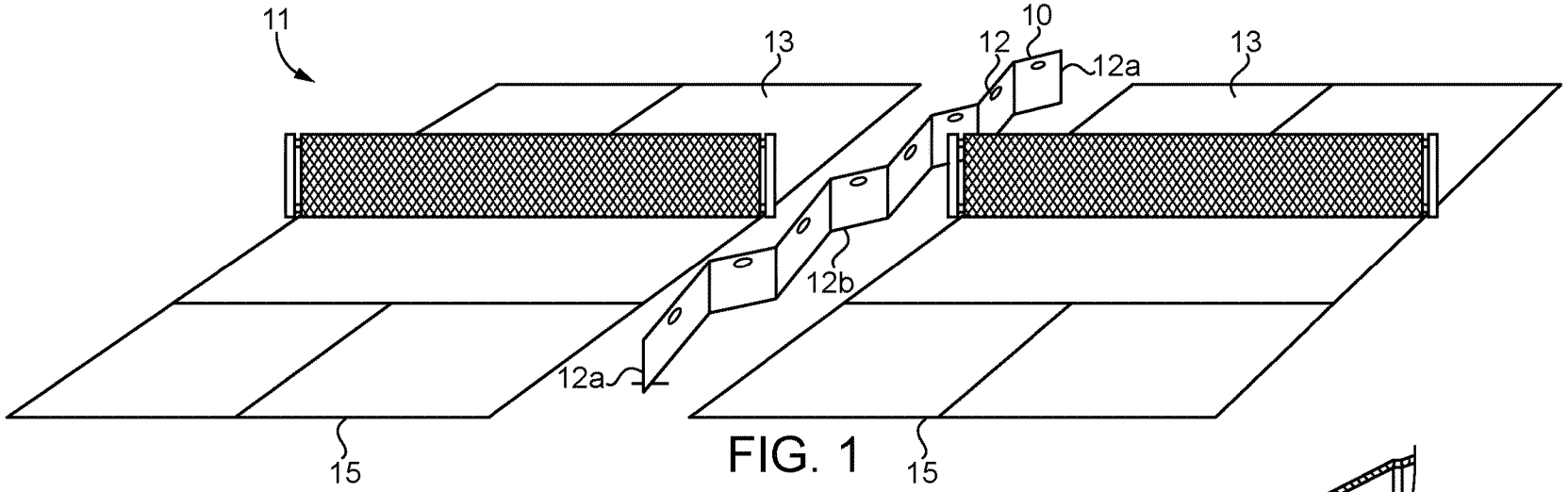
FIG. 1 is a diagrammatic view of a system for playing pickleball, according to one embodiment.

Referring now to FIG. 1, a system for playing pickleball ("system") 11 is shown according to one embodiment.

System 11 includes a pickleball barrier ("barrier") 10, which is shown in FIG. 1 in a deployed configuration, positioned between adjacent pickleball courts 13. Additional barriers similar or identical to barrier 10 might be positioned at end of each of courts 13 and/or at outer sides thereof. Based on the unique combinations of design configurations and materials disclosed herein, one can alternate barrier 10 between a deployed configuration to arrest errant pickleballs, and a folded configuration to transport barrier 10 once a user has finished playing or otherwise desires to remove or transport barrier 10.

Figure 2:
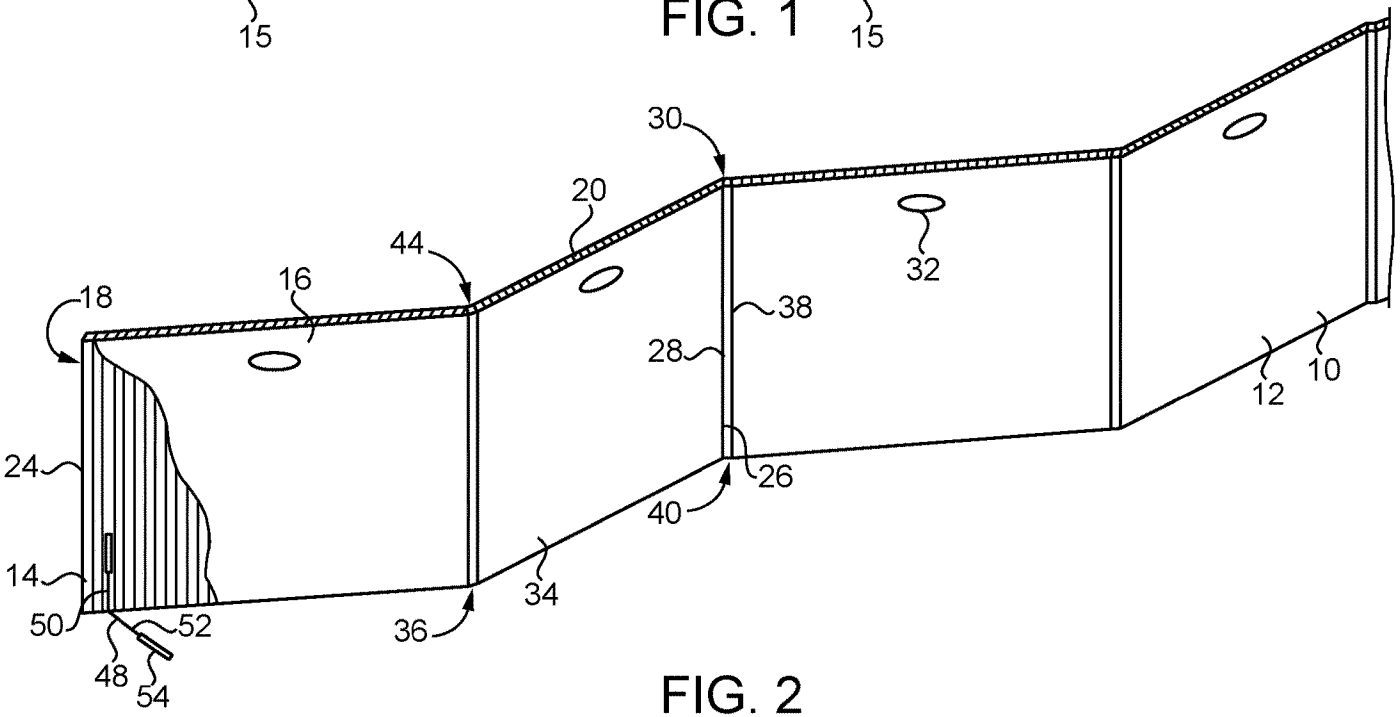
FIG. 2 is a partially sectioned perspective view of a pickleball barrier in a deployed configuration, according to one embodiment.

Referring now also to FIG. 2, barrier 10 is shown in the deployed configuration in a partial cutaway view. Barrier 10 includes a plurality of panels 12 formed of a substantially straight fluted material having a plurality substantially straight channels 14 which include flutes (hereinafter "flutes 14"), disposed between a first rigid surface 16 and a second rigid surface 18. Panels 12 may be formed of a corrugated plastic material (e.g., PolyFlute®, Coroplast®, IntePro®, Correx®) or other weather-resistant material. In other examples, panels may be made from cellulosic materials such as cardboard, paperboard, corrugated fiberboard, and the like which may be coated with wax, lacquer, plastic, or other suitable materials for increasing durability and/or water resistance. Optionally, panels 12 may include printing on one or more surfaces such as logos, words, designs, and the like. Panels 12 may be weather resistant in that they are structured to withstand rain or wind that may be experienced while playing pickleball on an outdoor court, and are durable in that panels 12 may be able to withstand repeated impact, torsion, or other forces resulting from regular folding and unfolding, transport, or from players running into barrier 10 during the course of play, amongst other things. Panels 12 could be coated with or impregnated with, or formed of, a UV-stabilizer in some instances. The multiple layer, fluted structure of panels 12 also enables barrier 10 to be more easily transportable, as it will be substantially lighter than a similar structure formed of solid materials such as certain plastics or metal. The lighter construction of panels 12 may also help to prevent player injuries in some instances, as, for example, barrier 10 according to the present disclosure may be less likely to trip players, amongst other things. Barrier 10 may thus be better suited for use than known strategies in many contexts; particularly contexts in which barrier 10 might be used by elderly players.

Panels 12 are typically rectangular in shape, with flutes 14 coupling first rigid surface 16 and second rigid surface 18 and extending between a top edge 20 and a bottom edge 22, and running parallel with a first side edge 24 and a second side edge 26. In other embodiments, panels 12 might have a rounded top edge 20, angled side edges 24, 26, or any other suitable shape. The terms "top" and "bottom," and "right" and "left," and like directional terms are used herein in a relative sense, each in relation to each other when viewing barrier 10 and should not necessarily be taken to mean that barrier 10 or its elements have a particular orientation.

It has been observed that pickleballs escaping a pickleball court 13 during play, at least those escaping the sides of the court, are rarely more than 2-feet off the court surface and are generally within the middle section of the court rather than near the baselines 15. Barrier 10 may therefore be structured to be able to arrest errant pickleballs within a zone extending about 16 to about 18-feet from the net (in both directions), and about 2-feet off the surface of the court. Limiting a height dimension and a length dimension of barrier 10 in a manner calculated to arrest pickleballs only within this zone may be advantageous for a number of reasons. For instance, limiting height or length dimensions may also limit a size and weight of barrier 10 in the folded configuration, which allows for easier transport. A relatively short height dimension may also allow players to step over or otherwise avoid tripping on barrier 10, and may make production of barrier 10 more cost effective. In a practical implementation strategy, barrier 10 will have a height about 2-feet or less, and a length that is at least a majority of a length of a standard pickleball court, which is 44-feet, although in some embodiments, the height or length of barrier 10 could be longer or shorter. For instance, as suggested above it may be desirable to produce a barrier 10 to arrest pickleballs escaping the back of a pickleball court past one of the baselines 15, in which case the length of barrier 10 might be less than the width of a standard pickleball court (i.e., 20-feet). As used herein, the term "about" can be understood in the context of conventional rounding to a consistent number of significant digits. Accordingly, "about 2-feet" can be understood to mean from 1.5-feet to 2.4-feet, and so on.

Each panel 12 may be rigidly attached to another panel 12 by a rigid bond 28 at an interpanel joint 30. Interpanel joint 30 may be formed by attaching two panels 12 in an end-to-end configuration, or might instead be formed by overlapping edges 24 and 26 of two panels 12 as further discussed below. In either embodiment, the length or number of panels 12 may be adjusted to account for any length added or lost in forming interpanel joint 30. In an alternative embodiment, barrier 10 could instead be formed from a single panel 12, although, those of skill in the art will recognize that single panel constructions may introduce additional costs that could unduly encumber cost effective production of barrier 10. Interpanel joint 30 may couple panels 12 such that barrier 10 has a substantially continuous extent in that surfaces 16, 18 may be substantially free of gaps, apertures, or other openings through which a pickleball may fit (i.e., less than about 2.75-3 inches, which is the diameter of standard-sized pickleballs). Although panels 12 may include one or more handle openings 32 formed within surfaces 16, 18, each handle opening 32 will typically be structured such that a standard pickleball will not be able to pass therethrough.

Rigid bond 28 may be formed through use of any suitable bonding strategy such as, for example, ultrasonic welding, thermal bonding, or the use of tape, fasteners, or glues such as a cyanoacrylate, a hot-melt adhesive, or a polyvinyl acetate. While typically each interpanel joint 30 includes a rigid bond 28, in an alternative embodiment, interpanel joint 30 might be formed by a movable joint, for instance certain types of tape, that allows adjacent panels 12 to move relative to each other. In such an embodiment, interpanel joint 30 might not include a rigid bond 28.

Figure 3:
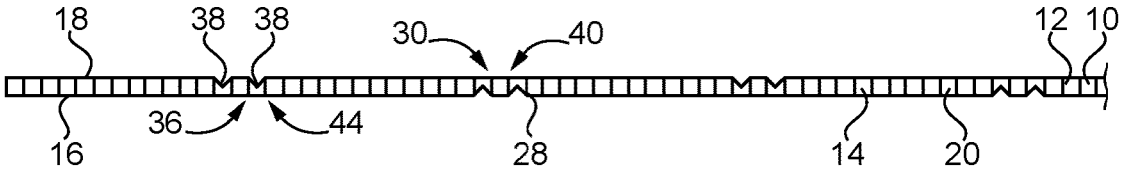
FIG. 3 is a diagrammatic top view of a pickleball barrier in a first configuration, according to one embodiment.
Figure 4:
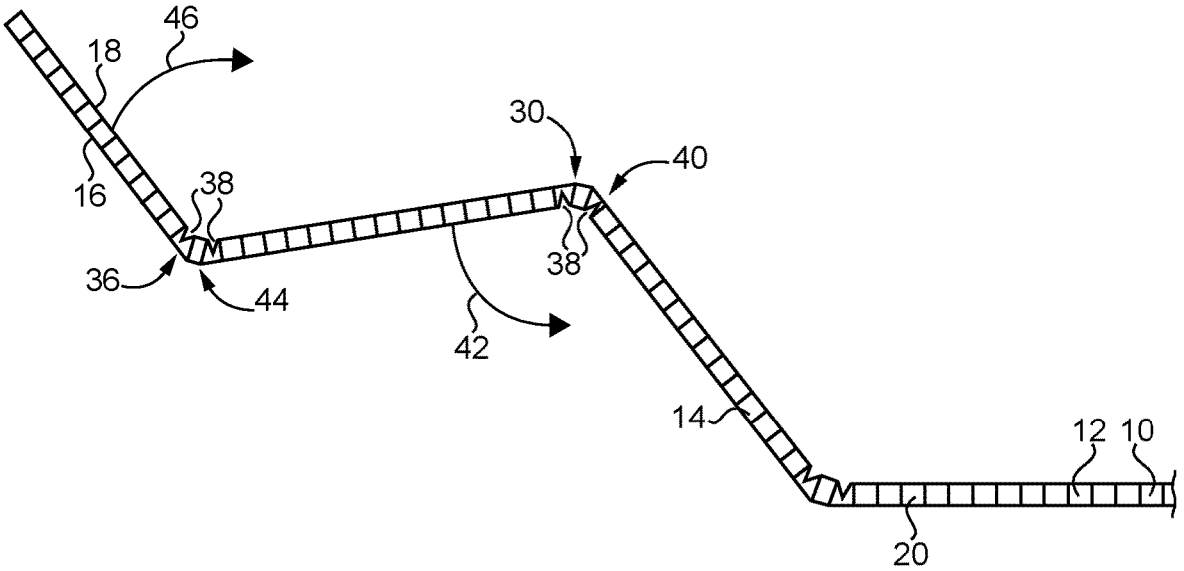
FIG. 4 is a diagrammatic top view of a pickleball barrier in a second configuration, according to one embodiment.

For barrier 10 to reach a desired length, panels 12 may be attached in a chain-like manner, with each panel 12 being attached to a subsequent panel 12 by an interpanel joint 30. It will be appreciated that a desired or target length of barrier 10 could be a linear distance between opposite ends of the barrier 10 in a deployed (i.e., biased) configuration (as seen in FIG. 4), or in a substantially straight (i.e., unbiased) configuration (as seen in FIG. 3). As can be seen, panels 12 can be either an end panel 12*a* or a middle panel 12*b*. Each end panel 12*a* typically includes only a single interpanel joint 30, while middle panels 12*b* will typically be attached to two panels 12, with interpanel joints 30 at both side edges 24, 26. In an exemplary embodiment, barrier 10 includes four panels 12 that are each about 8-feet long such that barrier 10 is about 32-feet long when substantially straight (i.e., not folded or biased). Where panels 12 are formed of a corrugated plastic material, 8-feet may be a desirable length for each panel 12 as that is the standard maximum width for commercially available sheets of plastic corrugated boards, wherein the width is measured in a direction opposite an orientation of flutes 14. Cellulosic materials may have analogous dimensional constraints. As such, the use of 8-feet wide panels may be desirable as additional costs related to custom forming or shipping oversized corrugated sheets may limit the ability to cost effectively produce barriers 10. It will be appreciated that, in some instances, it might be possible to cost effectively produce barrier 10 using panels 12 having a longer or shorter length, however.

Barrier 10 is divided into a plurality of sections that may include substantially equal length sections 34. Each section 34 may be separated from adjacent sections 34 by an interpanel joint 30 formed between adjacent panels 12, or an intrapanel joint 36 formed within a single panel 12. For instance, in the present, exemplary embodiment, barrier 10 includes four congruent panels 12, each divided into two equal sections 34 to form eight congruent sections 34, each section 34 being separated from adjacent sections 34 by one of the three interpanel joints 30 or the four intrapanel joints 36 formed in barrier 10. In other embodiments, sections 34 may be divided only by intrapanel joints 36, or, if sections 34 have the same length as panels 12, only by interpanel joints 30. In still other embodiments, one or more interpanel joints 30 might not correspond with a boundary of a section 34 at all, with each section 34 being separated from adjacent sections 34 by an intrapanel joint 36.

Referring now also to FIGS. 3-4, top views of barrier 10 are illustrated. Each joint 30, 36 that separates adjacent sections 34 will include two or more fold lines 38 formed in either first rigid surface 16 or second rigid surface 18. In other words, fold lines 38 within the same joint 30, 36 will be formed in the same surface 16, 18. Each fold line 38 corresponds with one of the plurality of flutes 14 in that each fold line 38 extends between top edge 20 and bottom edge 22 within the corresponding flute 14. Fold lines 38 are formed by deforming—which typically will include creasing—either first rigid surface 16 or second rigid surface 18 prior to folding barrier 10. In some embodiments, fold lines 38 may be formed by scoring or perforating either surface 16, 18, or may be formed by any other suitable technique. Where an edge of a section 34 corresponds with a side edge 24, 26 of a panel 12, the corresponding interpanel joint 36 may include both a plurality of fold lines 38 and a rigid bond 28. Rigid bond 28 and fold lines 38 may be arranged in any suitable manner. For instance, the plurality of fold lines 38 may all be formed on one side or the other of rigid bond 28, or fold lines 38 might be formed on both sides of rigid bond.

Each fold line 38 is structured to cause barrier 10 to bias in the direction of the surface 16, 18 in which the fold line 38 was formed. Put another way, as can be seen in FIG. 4, each fold line 38 may cause barrier 10 to bias such that surfaces 16, 18 adjacent to the fold line 38 form an acute angle. Fold lines 38 formed in first rigid surface 16 may therefore cause barrier to bias in an opposite direction than fold lines 38 formed in second rigid surface 18. Accordingly, when viewing barrier 10 from above (as illustrated in FIGS. 3-4), each interpanel joint 30 and each intrapanel joint 36 might form either a rightwardly biasing hinge 40 that permits barrier 10 to be folded in a righthand direction 42, or a leftwardly biasing hinge 44 that permits barrier 10 to be folded in a lefthand direction 46.

Joint 30 may be formed in any arrangement within barrier 10. Hinges 40, 44, however, are formed at substantially equal intervals within barrier 10 such that each section 34 has a substantially identical length. In some embodiments, such as the present embodiment, each section 34 may be substantially congruent in both size and shape, and hinges 40 and 44 may be coincident with joints 30 and 36. In other words, joints 30 and 36 may themselves be or include hinges 40 and 44 although as discussed herein variations are contemplated. Further, rightwardly biasing hinges 40 and leftwardly biasing hinges 44 are formed in an alternating arrangement such that barrier 10 biases to have an accordion-like shape in the deployed configuration, which may assist in enhancing the stability of barrier while in use.

Barrier 10 may also include one or more configurable stands ("stands") 48 coupled therewith. Each stand 48 may be T-shaped, with a coupling prong 50 and two legs 52. Coupling prong 50 may be structured to fit within flute 14 from bottom edge 22 such that legs 52 extend outward from barrier 10. In this way, stand 48 may be coupled with barrier 10 in a manner that does not add to a width of barrier 10 between rigid surfaces 16 and 18, or that does not otherwise interfere with the ability to adjust barrier 10 to the folded configuration (i.e., allows each section 34 to lay flat against adjacent sections 34, as will be seen in FIGS. 5-6 and the accompanying discussion hereinafter). When barrier 10 is in the deployed configuration, legs 52 may be in a support orientation in which they are oriented substantially perpendicular to the section 34 with which stand 48 is coupled. When barrier 10 is in the folded configuration, legs 52 may be rotated around an axis of rotation defined by coupling prong 50 such that legs 52 are in a transport orientation in which they are substantially parallel with the corresponding section 34. Coupling prong 50 and legs 52 might include a cap piece 54 made of rubber or another material structured to grip or durably engage either panel 12 or the surface of indoor or outdoor pickleball courts. In other embodiments, stand 48 may have any other suitable shape, or may be coupled with barrier 10 in any other manner that allows stand 48 to be configured differently in the deployed and the folded configurations. For example, stand 48 may be clipped or fastened to barrier 10, or may be attached to a surface 16, 18 or an edge 22, 24, 26 of barrier 10.

Figure 5:
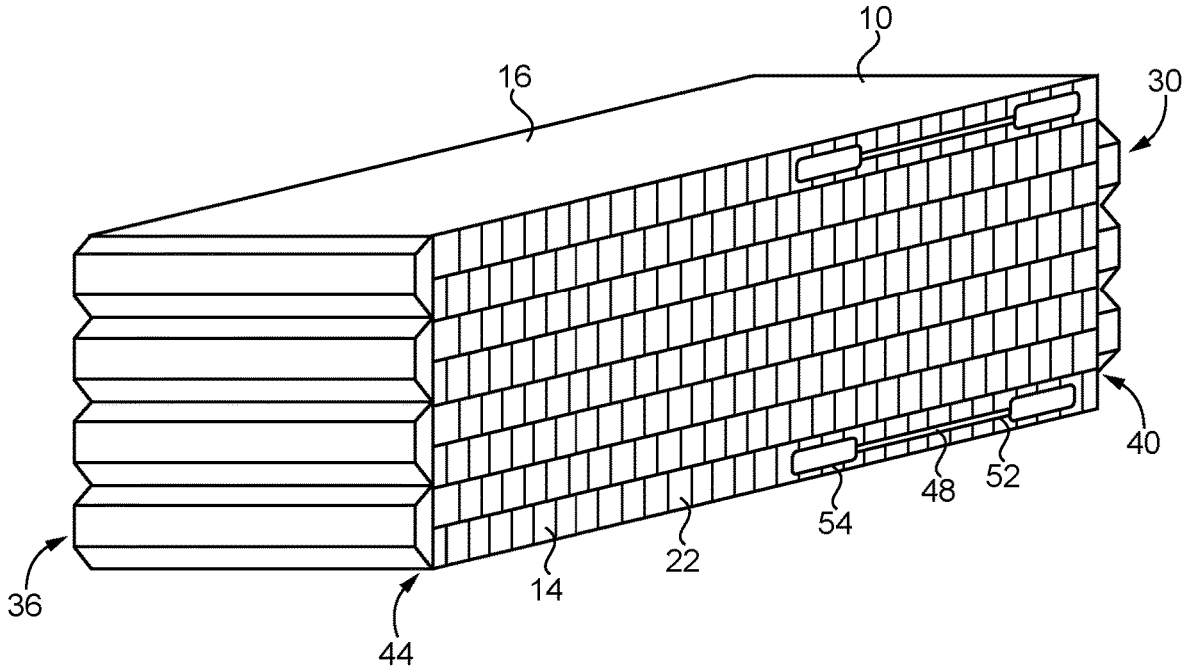
FIG. 5 is a diagrammatic perspective view of a pickleball barrier in a folded configuration, according to one embodiment.
Figure 6:
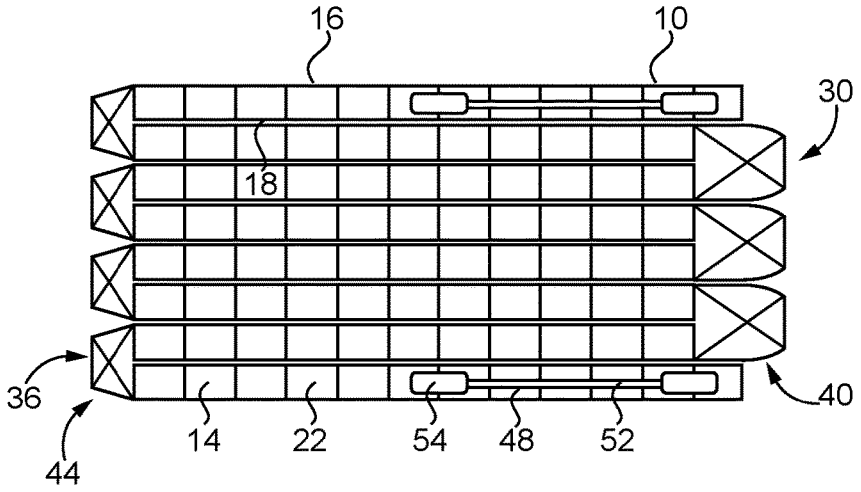
FIG. 6 is a diagrammatic view of a pickleball barrier in a folded configuration, according to one embodiment.

Referring now also to FIGS. 5-6, barrier 10 is shown in the folded configuration. In FIG. 6, joints 36 and 30 are shown with different diagrammatic representations, as it will be appreciated that joints 36 and 30 have different configurations. Hinges 40, 44 allow barrier 10 to be folded in a manner that permits each section 34 to lay flat on an adjacent section 34 in the folded configuration, through operation of fold lines 38. Each fold line 38 may allow barrier 10 to fold to a certain degree without crushing, impinging, or otherwise deforming flutes 14 not having a fold line 38 formed therein. For instance, in an embodiment, each fold line 38 might permit barrier 10 to bend about 90 degrees in a righthand direction. In such an embodiment, folding barrier 10 beyond 90 degrees in the righthand direction may result in deformation of flutes 14 adjacent to the fold line 38, or may result in tension accruing within the hinge formed by the fold line 38, which might cause barrier to spring open while in the folded configuration. In this way, a rightwardly biasing hinge 40 that includes only a single fold line 38 may actually cause barrier 10 to bias in the lefthand direction in the folded configuration. In contrast, it has been observed that hinges 40, 44 including two or more fold lines 38 may be allow barrier 10 to be folded at 180 degrees or more, allowing adjacent sections 34 to lay flat on each other in the folded configuration without undesired biasing in a direction opposite the folding direction.

Figure 7:
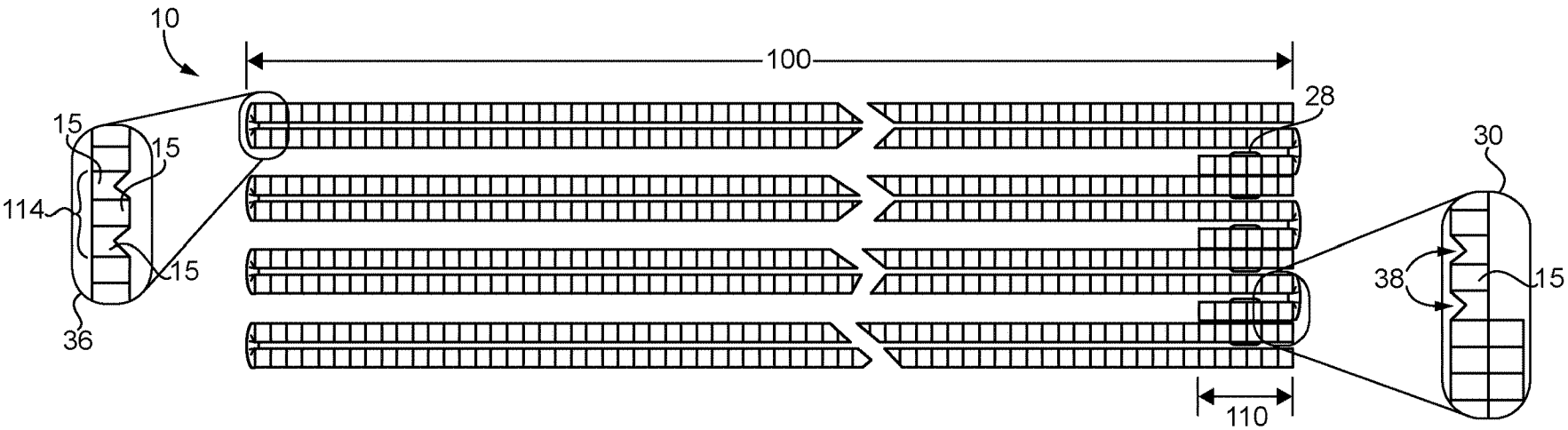
FIG. 7 is another diagrammatic view of a pickleball barrier in a folded configuration, including detailed enlargements.
Figure 8:
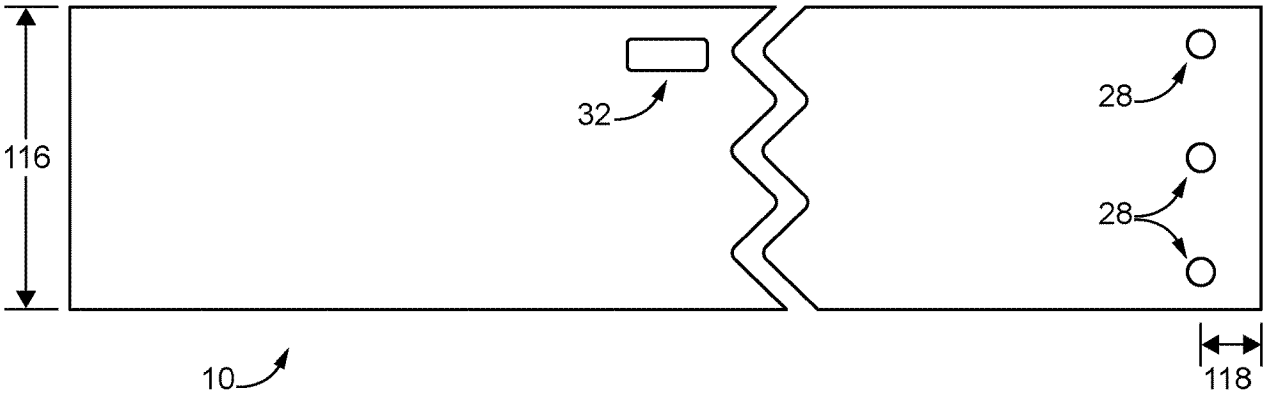
FIG. 8 is a side view of a panel for a pickleball barrier, according to one embodiment.

Referring now to FIGS. 7 and 8, there are shown features of barrier 10 including detailed enlargements in FIG. 7 illustrating additional features of joints 30 and 36. It will be recalled that interpanel joints 30 can be structured in a variety of ways, including by overlapping adjacent panels. In the right detailed enlargement in FIG. 7 it can be seen that one panel overlaps an adjacent panel just next two each joint 30. A rigid joint 28 attaches the adjacent panels, and a plurality of individual rigid attachment locations may form rigid joint 28, each shown with the same reference numeral 28 as in FIG. 8. In the case of ultrasonic welding, such as where barrier 10 is formed of polymeric material, the plurality of attachment locations can include spot welds. As suggested above, an adhesive or other attachment technique such as tapes or fasteners might be used. It can also be noted that a total of one flute is between a total of two fold lines 38 in joint 30. A similar configuration is used with joint 36 where reference numeral 114 identifies three flutes 15 that together comprise joint 36.

FIGS. 7 and 8 also show certain dimensional attributes discussed herein, including a full panel length 100 that may be about 48 inches, a panel height 116 that may be about 12 inches, an extent of panel overlap 110 that may be about 2 inches, and a rigid joint locating dimension 118. Dimension 118 may be about 2 inches and is a running distance from an end of a panel in barrier 10 to an approximate center point of spot welds, or to an approximate center of a taped or glued seam or the like in the subject interpanel joint 30. As also noted herein, a location of attachments between adjacent panels, i.e. the interpanel joints, is not necessarily linked to the locations of hinges, and an interpanel joint might be located essentially anywhere in barrier 10. Locating interpanel joints adjacent to and substantially coincident with hinges in barrier 10 provides a practical implementation strategy.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different devices, assemblies, and methods having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. A pickleball barrier comprising:

a plurality of rigid panels including a first end panel, a second end panel, and a middle panel, the plurality of rigid panels being formed of a corrugated material having a first rigid surface, a second rigid surface, and a plurality of flutes coupling the first rigid surface with the second rigid surface and extending between a top edge and a bottom edge in the respective angle, and each of the panels having a height of about 2-feet or less;

a plurality of interpanel joints each attaching one of the plurality of panels to another one of the plurality of panels such that the plurality of panels have a chain-like arrangement in a deployed configuration, each of the plurality of interpanel joints including a rigid bond and a plurality of fold lines in the first rigid surface forming a rightwardly biasing hinge, permitting the pickleball barrier to be folded, in an edge-on view of the top edges of the attached plurality of panels, in a righthand direction;

a plurality of intrapanel joints including a plurality of fold lines in the second rigid surface forming a leftwardly biasing hinge, permitting the pickleball barrier to be folded, in the edge-on view of the top edges of the attached plurality of panels, in a lefthand direction opposite to the righthand direction, each intrapanel joint dividing each of the plurality of rigid panels into two sections; and a stand coupled one of the plurality of rigid panels such that the stand is partially within the one of the plurality of flutes of the corresponding one of the plurality of rigid panels.

2. The pickleball barrier of claim 1, wherein the plurality of panels is about 20-feet long or greater in a deployed configuration.

3. The pickleball barrier of claim 1, wherein each of the two sections of the plurality of ridged panels includes a handle opening, and the handle openings are in register with one another in a transport orientation.

4. The pickleball barrier of claim 1, wherein the stand can be rotated between a support orientation substantially perpendicular to the corresponding one of the plurality of panels, and a transport orientation substantially parallel with the corresponding one of the plurality of panels.

5. The pickleball barrier of claim 1, wherein the corrugated material is a plastic material.

6. The pickleball barrier of claim 1, wherein the corrugated material is a cellulosic material.

7. The pickleball barrier of claim 1 wherein the plurality of rigid panels includes at least four panels that are each about 8-feet long.

8. A pickleball barrier comprising:

a plurality of panels each including a top edge, a bottom edge, and two side edges, the plurality of panels being formed of a multiple layered material having a first rigid surface and a second rigid surface, wherein the first rigid surface and the second rigid surface are coupled so as to form a plurality of substantially straight channels extending between the top edge and the bottom edge;

a plurality of interpanel joints rigidly coupling the plurality of panels in a chain-like manner;

plurality of rightwardly biasing hinges and a plurality of leftwardly biasing hinges being formed at equal intervals within the pickleball barrier in an alternating arrangement, the rightwardly biasing hinges including a plurality of fold lines formed in the first rigid surface and corresponding with one of the plurality of substantially straight channels, each of the plurality of fold lines being structured to cause the pickleball barrier to bias in a righthand direction, in an edge-on view of the top edges of the coupled plurality of panels;

and the leftwardly biasing hinges including a plurality of fold lines formed in the second rigid surface and corresponding with one of the plurality of substantially straight channels, each one of the plurality of fold lines structured to cause the pickleball barrier to bias in a lefthand direction, in the edge-on view of the top edges of the coupled plurality of panels.

9. The pickleball barrier of claim 8 wherein one of the plurality of interpanel joints includes a rightwardly biasing hinge.

10. The pickleball barrier of claim 8 wherein each of the plurality of rightwardly biasing hinges are structured to fold in a first direction only, and each of the plurality of leftwardly biasing hinges are structured to fold in a second direction only.

11. The pickleball barrier of claim 8 wherein each of the plurality of fold lines is within only a single one of the substantially straight channels.

12. The pickleball barrier of claim 11 wherein the plurality of fold lines include creases arranged in the corresponding one of the rightwardly biasing hinge or the leftwardly biasing hinge and each separated from one another by a total of one substantially straight channel.

13. The pickleball barrier of claim 8, wherein the multiple layered material is a plastic material.

14. The pickleball barrier of claim 8, wherein the multiple layered material is a cellulosic material.

15. A method of packaging a deployable pickleball barrier comprising:

cutting a material into panels each having a height of about 2-feet or less, the material having a first rigid surface and a second rigid surface coupled to the first rigid surface by a substantially straight channel;

rigidly attaching the panels in a chain-like manner to form a deployable pickleball barrier having a height of about 2-feet or less, each of the panels being attached to at least one other panel by an interpanel joint;

configuring the deployable pickleball barrier to have a deployed configuration in which the deployable pickleball barrier has an accordion-like shape at least in part by:

forming a plurality of fold lines in the first rigid surface within each of the interpanel joints to form a rightwardly biasing hinge structured to bias the deployable pickleball barrier in a righthand direction, in an edge-on view of the top edges of the attached panels;

forming a plurality of intrapanel joints within the deployable pickleball barrier such that each pair of intrapanel joints is interrupted by an interpanel joint, each of the plurality of intrapanel joints including a plurality of fold lines formed in the second rigid surface to form a leftwardly biasing hinge structured to bias the deployable pickleball barrier in a lefthand direction, in the edge-on view of the top edges, and wherein an alternating arrangement of the intrapanel joints and the interpanel joints forms a plurality of substantially equal length sections within the deployable pickleball barrier; and adjusting the deployable pickleball barrier to a folded configuration in which each of the plurality of sections registers with an adjacent one of the plurality of sections by: folding the deployable pickleball barrier in the righthand direction at each of the plurality of intrapanel joints, and folding the deployable pickleball barrier in the lefthand direction at each of the plurality of interpanel joints.

16. The method of claim 15 wherein rigidly attaching the panels includes forming a rigid bond between the panels.

17. The method of claim 15 wherein forming each of the plurality of fold lines includes creasing only one of the first rigid surface or the second rigid surface.

18. The method of claim 15 further including coupling a rotatable stand with at least one of the panels.

19. The method of claim 18 wherein coupling the rotatable stand with at least one of the panels includes sliding a prong of the rotatable stand into the substantially straight channel.

* * * * *